United States Patent [19]

Marcus

[11] Patent Number: 4,815,789

[45] Date of Patent: Mar. 28, 1989

[54] CHAIR KIT

[75] Inventor: Fred Marcus, Niles, Ill.

[73] Assignee: Marcus Industries, Inc., Niles, Ill.

[21] Appl. No.: 136,012

[22] Filed: Dec. 21, 1987

[51] Int. Cl.[4] ..... A47C 7/00

[52] U.S. Cl. ..... 297/440; 297/218; 297/422

[58] Field of Search ..... 297/440, DIG. 1, 450, 297/422, 218, 134

[56] References Cited

U.S. PATENT DOCUMENTS

| | | | |
|---|---|---|---|
| 128,361 | 6/1872 | Clark | 297/134 X |
| 1,267,800 | 5/1918 | Peterman | 297/134 X |
| 1,674,220 | 6/1928 | Percival | 297/440 X |
| 1,933,372 | 10/1933 | Fisher | 297/218 |
| 2,257,211 | 9/1941 | Willoughby | 297/440 X |
| 2,515,860 | 8/1950 | Blue | 297/422 X |
| 2,570,609 | 10/1951 | Taylor, Jr. | 297/440 X |
| 3,054,156 | 9/1962 | Cohen | 297/440 |
| 3,759,571 | 9/1973 | Korch | 297/440 X |
| 3,874,729 | 4/1975 | Blodee | 297/440 |

FOREIGN PATENT DOCUMENTS 365461 12/1922 Fed. Rep. of Germany ..... 297/440

*Primary Examiner*—Francis K. Zugel
*Attorney, Agent, or Firm*—Russell E. Hattis

[57] ABSTRACT

The present invention is directed to assemblies and sub-assemblies for incorporation into a chair, to a chair kit that comprises these assemblies and sub-assemblies, and to the chair itself. It includes substantially rectangular seat and back cushion sub-assemblies for incorporation into a chair. The seat and back cushion sub-assemblies may be readily removed from and replaced onto the chair itself, thereby facilitating the replacement of a rigidifying inner foam pad. The invention also includes a novel means of securing cushions to the chairs. This means comprises a rigid, substantially rectangular seat frame member having laterally opposed slots along its inner portion. At least one fixedly secured and at least one movably secured screw-receiving leg is attached to this seat frame member.

18 Claims, 2 Drawing Sheets

FIG. 4
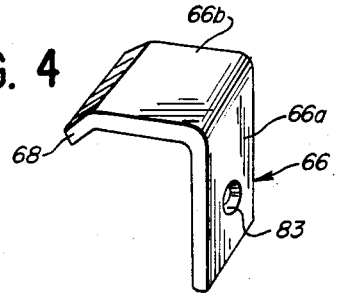
FIG. 5
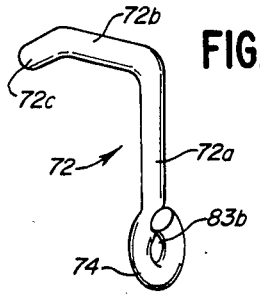
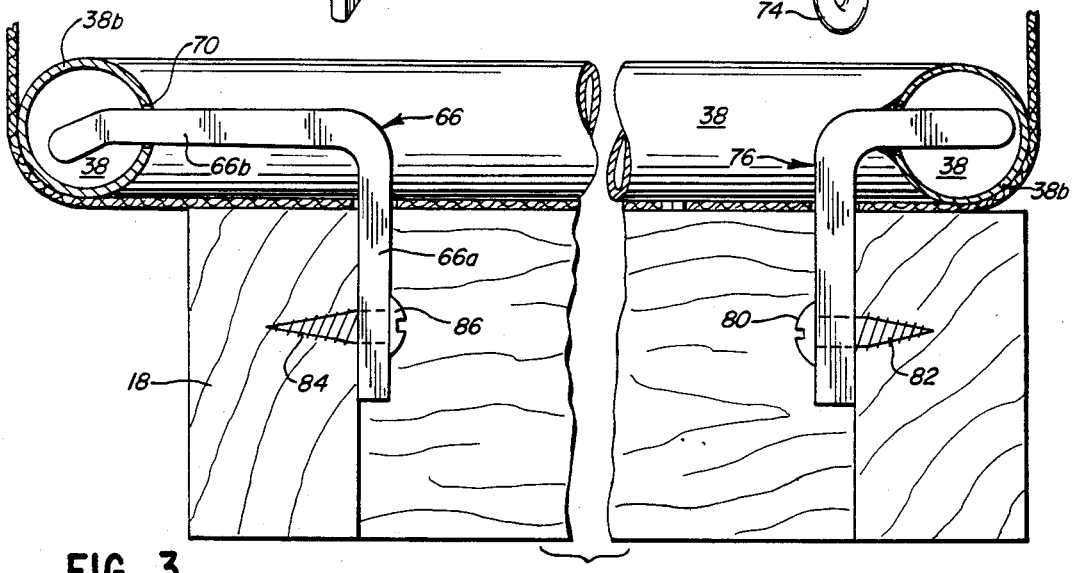
FIG. 3
FIG. 6
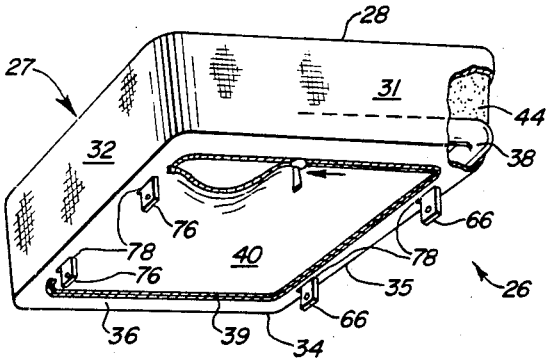
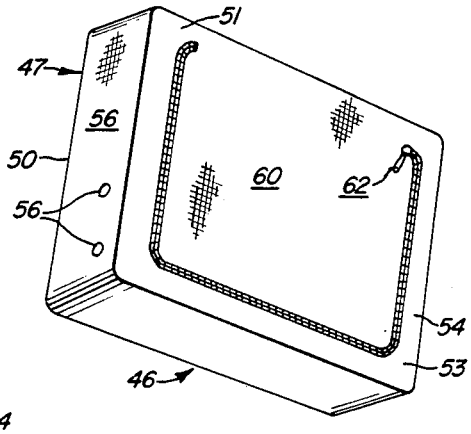
FIG. 7

CHAIR KIT

DESCRIPTION

1. Technical Field

This invention relates to a novel kit including components to be assembled into a chair, and to a new back cushion subassembly, seat cushion sub-assembly, seat frame construction, and means for connecting the seat frame, preferably through a unique seat cover, to a seat cushion sub-assembly support.

The cushions and their related covers, frame construction and interconnecting means of the invention have several advantages. First, the novel seat cushions can be recovered and connected to the seat frame without the need of an upholsterer's services. Second, through use of the seat frame, novel cover and interconnecting means, the seat cushion and frame may be placed onto and readily secured to the chair's structural seat cushion sub-assembly support, regardless of slight manufacturing variances in, for example, the placement of screw-retaining holes within that seat cushion subassembly support.

BACKGROUND OF THE INVENTION

Generally, it is desirable for upholstered seat and back cushions for a chair to be secured in some manner to the chair's frame so that the cushions will not shift along that frame during use. It is known in the prior art to enclose a metal frame within and along the periphery of the seat or back cushion to provide the upholstered and foam-filled cushion with strength, shape, and rigidity. In one prior art construction, hook-shaped members were secured to this frame, and these members were then secured as by screws to screw-receiving holes in the adjacent seat cushion sub-assembly support of the chair. However, variations in the position of these drilled screw-receiving holes due to loose hole placement tolerances led to difficulties in securing the hook shaped members to that support. This would then necessarily require the reworking of the holes in the seat cushion support.

Yet another problem with prior art seat cushion subassemblies was that they generally required professional servicing when the interior padding had deteriorated to the point where it no longer provided adequate support. Prior art cushions included so-called "hog rings" to secure the fabric covering to the backside of the cushion or to the cushion's inner frame. When the padding had worn, the hog rings needed to be removed, the fabric covering peeled away from the padding, new padding inserted adjacent the fabric covering, and the hog rings resecured. However, the typical chair owner does not have access to hog rings and would not, in any event, be adequately trained to service such cushions.

SUMMARY OF THE INVENTION

In accordance with one of the aspects of the invention, an unique cushion cover is provided for the seat and back cushion as part of a chair construction kit. Each cover includes a normally exposed, front or top panel, four side panels secured to the front or top panel, and a normally unexposed, rear or bottom cover flap. The cover flap is contiguous with each of the side panels and is removably engaged, as for example by a zipper either directly or indirectly, to three of these side panels. By means of this removable engagement, the cover flap may be swung away from the side panels to reveal and permit access for insertion or replacement of a rigidifying inner frame and cushion within the interior of the cushion cover. The cover has holes to receive means for anchoring the entire cushion, frame and cover sub-assembly to a part of the chair frame.

In the case of the seat cushion subassembly, the seat frame to be placed inside the cushion cover comprises a substantially rectangular frame with at least one pair of longitudinally spaced slots along an inwardly-facing portion of one of the sides of the frame. Each side of the frame is preferably made of metal tubular stock. The horizontal legs of a pair of angle members are inserted within these slots. The other vertical legs of these angle members pass through apertures in the periphery of the bottom of the cushion cover, and are anchored by screws to the inner face of one of the sides of a rectangular seat cushion sub-assembly support frame beneath the seat cushion sub-assembly. It should be understood, however, that the broadest aspect of the cushion cover sub-assembly of the invention does not require these angle members.

The angle members may be of a generally flat stock, but are preferably of a generally round stock. If the movably secured angle member is of a generally flat stock, then its corresponding frame slot will be of a generally rectangular shape, and will have a width and length somewhat greater than the width and length of the flat stock. In this manner, the horizontal leg portion within the slot will be slightly laterally and vertically movable, permitting corresponding slight lateral and vertical movement of the angle member. If, however, the movably secured angle member is of a generally round stock, then its corresponding slot will be of a generally round shape, and will have a diameter only slightly larger than the diameter of its horizontal leg. In this manner, the horizontal leg within the slot will be rotatable, and will also be somewhat pivotable relative to the adjacent seat cushion sub-assembly support.

The kit also has parts to fabricate a back cushion sub-assembly which includes a cover similar to that used in the seat cushion sub-assembly just described. The back cushion sub-assembly, however, would usually have a differently constructed frame. The frame would be secured by screws passing through aligned holes in both a chair side frame and the side panels of the back cushion cover, which screws thread into T-nuts anchored in the back cushion frame member.

It is apparent that the above-described invention provides parts for a chair construction kit to enable seat and back cushion sub-assemblies to be readily assembled or dis-assembled, and which enable ready connection of these sub-assemblies to exterior chair frame pieces without the need for specialized and professional assistance. It is also apparent that the invention permits the attachment or fixing of the seat cushion sub-assemblies to the exterior frame pieces without some of the problems inherent in prior art designs.

BRIEF DESCRIPTION OF THE DRAWINGS

FIG. 3 is a vertical sectional view, taken along lines 3—3 of FIG. 1, of the rigid seat frame and the movably and fixedly secured angle members with their horizontal legs within their corresponding slots in the rigid seat frame;

FIG. 4 is a perspective view of a movably securable angle member in accordance with the invention, and made of a generally flat stock;

FIG. 5 is a perspective view of another movably securable angle member in accordance with the invention, but instead made of a generally-round stock;

FIG. 6 is a perspective, partly broken away view of a seat cushion subassembly of the invention, and showing, in a partially open position, the zipper with which the normally unexposed cover flap is secured to the periphery of the bottom side of the cover;

FIG. 7 is a perspective view of a back cushion subassembly of the invention, and showing the zipper with which the normally unexposed cover flap is secured to the rear side of the cover.

DESCRIPTION OF THE PREFERRED EMBODIMENT

Figure 1:
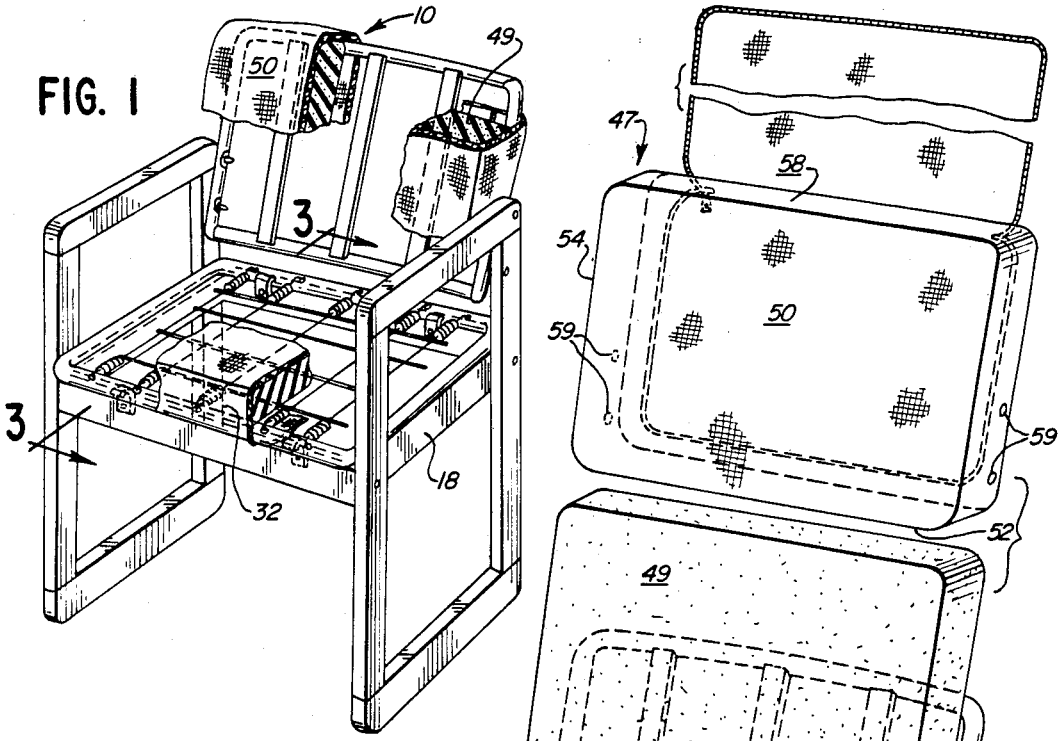
FIG. 1 is a perspective view, partially broken away, of an assembled chair in accordance with one embodiment of the invention.

Preliminarily, while this invention is susceptible of embodiment in many different forms, there is shown in the drawings and will herein be described in detail a preferred embodiment of the invention. However, the present disclosure is to be considered as an exemplification of the principles of the invention, and is not intended to limit the broad aspect of the invention to the embodiment illustrated.

Referring now to FIG. 1, a perspective, partially sectional view of a chair in accordance with the invention is shown. In particular, the chair 10 includes a pair of one-piece side frame members 12 and 14, which could be made of wood, and which act as a combination support leg for the chair itself and arm rest for the individual using that chair. The side frame members 12 and 14 also provide structural support for the entire chair, and are secured with screws 16 or similar fasteners to a seat cushion subassembly support 18 which may be made of wood, and anchored into rigid back cushion frame member 20, which also may be made of wood. The frame member 20 forms part of a back cushion sub-assembly to be described. T-nuts 24 are preferably anchored into seat cushion sub-assembly support 18 and back cushion frame member 20 to receive the screws 16. Holes 22 are provided both along the outward face of the seat cushion sub-assembly support 18 and in the rigid back cushion frame member 20 to receive the T-nuts 24.

Figure 2:
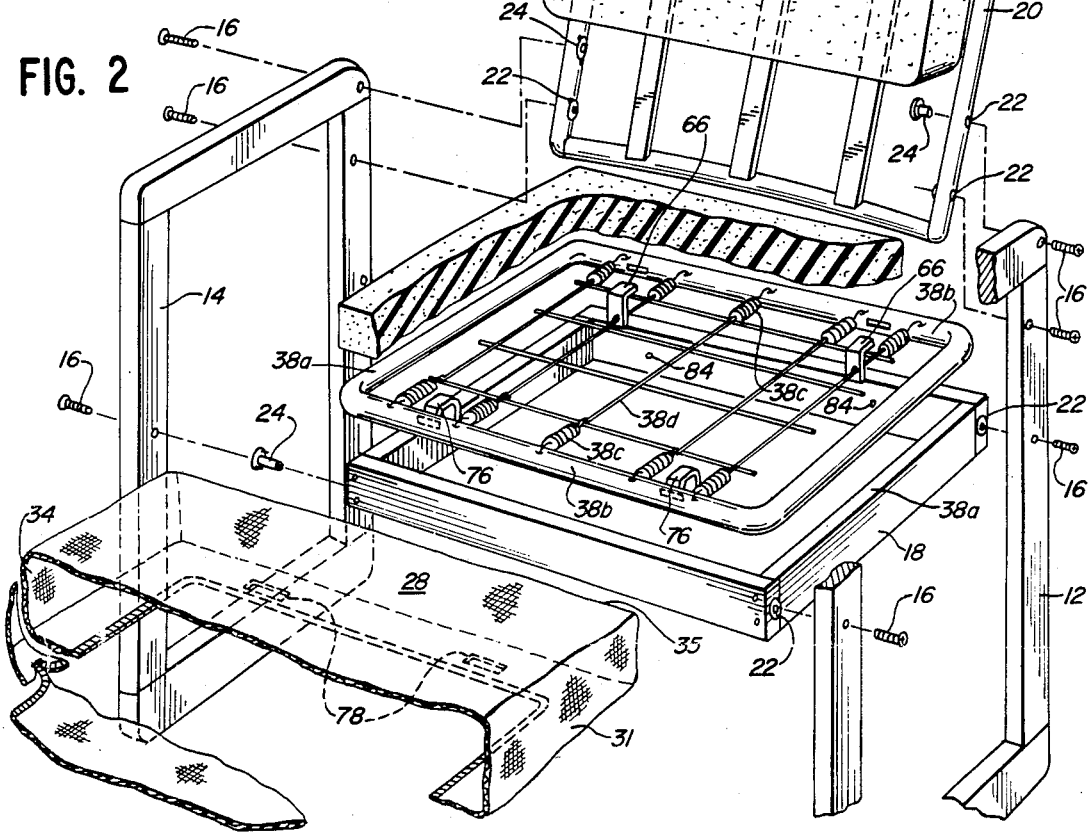
FIG. 2 is an enlarged, exploded view of the different parts of the kit of the present invention for making the chair of FIG. 1, and showing the flap of the seat and back cushion covers swung away from the contiguous side panels of those covers to permit placement of cushions and frames into the interiors of the respective covers.

The seat cushion sub-assembly 26 of the invention shown in FIG. 6 includes an outer cushion cover 27, for example of fabric, and including a normally exposed top panel 28 (FIG. 2). In the context of this specification, "normally exposed" is intended to mean that when the cushion sub-assembly is in place on a fully assembled chair, the panel involved is visible from the front of the chair. In contrast, a "normally unexposed" panel in this specification is one which is not generally visible to a viewer in front of the chair when the cushion sub-assembly is in place on a fully assembled chair. Secured to top panel 28 are four side panels, 31, 32, 34, and 35 (see FIGS. 2 and 6), which join a bottom panel 36 having a C-shaped slit 39 forming a flap 40. The cover is thus adapted to overlay and wrappingly surround a rigid seat frame 38 and a foam cushion 44. The margins of the flap 40 and slit are provided with a zipper closure assembly 42 to secure them together. It should be apparent to those skilled in the art that a functionally equivalent zipper 42 may be circumjacent the outer periphery of the bottom panel 36 and abutting the side panels, rather than inwardly spaced from the side panels as shown in the accompanying figures.

When the zipper closure assembly 42 is disengaged, cover flap 40 is loosened from the margins of the slit 39, permitting pivotable movement of the cover flap 40. The movement of this cover flap facilitates two distinct and desirable functions. This movement permits ready access to the foam cushion 44 and seat cushion frame 38 that are normally enclosed within the cover 27. The cushion 44 may thus be removed and replaced when it has deteriorated to the point where it no longer provides adequate support. This feature also permits ready replacement of the cushion cover 27 when it has worn out.

FIG. 7 shows the back cushion sub-assembly 46. It includes a fabric cover 47 similar to the seat cushion cover 27. The cover 47 thus facilitates insertion and removal of a foam cushion 49 (FIGS. 1 and 2) and the back cushion frame member 20 therefrom. As with the seat cushion sub-assembly 26, the cover 47 includes a normally exposed top panel 50 (FIG. 2), and four side panels 52, 54, 56 and 58 secured to that top panel 50. The cover 47 has a rear panel 51 having a C-shaped slit 53 (FIG. 7) which forms a flap 60. The rear panel 51 is normally unexposed, in that the chair is frequently placed with its back to a wall. Cover flap 60 is removably secured to the margins of this slit 53 by a zipper assembly 62. Upon disengagement or opening of the zipper 62, the cover flap 60 is pivotable to swing upwardly, outwardly, and away from the cover to permit the easy insertion or removal of foam cushion 49 and the frame member 20, or replacement of the back cushion cover 47 without the need for professional servicing.

Referring now to FIG. 2, side panels 54 and 56 of the cover 47 have screw pass-through holes 59 for passage of interconnecting means, which in this back cushion sub-assembly comprise four screws 16 passing through the respective upper ends of the side frame members 12 and 14 and threading into the T-nuts 24 anchored in the back cushion frame member 20.

In order to secure the seat cushion sub-assembly 26 to the chair, particularly to the seat cushion sub-assembly support 18, and thereby prevent shifting of the seat cushion 26 during use, the rigid seat frame 38 is uniquely designed to receive interconnecting means, which in this embodiment comprise the horizontal leg portions of angle members 66 and 76, to be described. The rigid seat frame 38 is preferably made of cylindrical tubular metal stock bent to form a rectangular peripheral frame with four side horizontal arms 38*a*—38*a* front and rear horizontal arms 38*b*—38*b*. Springs and wires 38*c* and 38*d* extend between these arms to form a resilient support for the seat cushion sub-assembly 44 placed on the top thereof. Two preferred configurations of these angle members are shown in FIGS. 4 and 5, which angle members are made of flat metal and cylindrical rod stock, respectively. FIG. 4 shows that the angle member 66 has a screw-receiving vertical leg 66*a* and a horizontal leg 66*b* terminating in a downwardly inclining lip 68. Each of the slots 70 in the front and rear arms 38*b* of the frame 38 has a somewhat greater length and width than the width and length of the cross-section of the angle member 66, typically 1/32" greater. Accordingly, the downwardly inclining lip portion 68 and the horizontal leg **66*b* of angle member 66 may initially move during assembly, to a limited extent, in vertical and lateral directions. As will be described hereinbelow, this initial movement of the downwardly inclining lip 68 is desirable during assembly. However, after assembly, a wedging action of the downwardly inclining lip 68, or any other portion of the horizontal leg 66*b* of angle member 66 against the periphery of its corresponding slot 70 will prevent movement of the downwardly inclining lip 68 and the angle member 66 itself. In this flat stock configuration of the angle member 66, the rigid seat frame 38** may be of any desired cross-section, but it must be tubular.

The other preferred configuration of an angle member 72 is as shown in FIG. 5. In this configuration, the angle member 72 is of a generally round stock. As with angle member 66, angle member 72 includes a vertical leg **72*a*, a horizontal leg 72*b*, and a downwardly inclining lip 72*c*. The angle member 72 also includes a screw-receiving eyelet 83*b* formed by bending the round stock. The slot in the rigid seat frame member 38 within which this angle member 72 is movably secured is circular, and of a very slightly greater diameter than the cross-sectional diameter of the angle member 72 itself. Accordingly, the horizontal leg 72*b* of angle member 72 may rotate freely within its slot and is also somewhat pivotable, that is, outwardly and inwardly, movable. For example, if the horizontal leg 72*b* of angle member 72 were housed within a circular slot in the rigid seat frame 38, there would be enough "play" or looseness between the angle member 72 and the periphery of its slot so that its bottom end 74 could be grasped and moved slightly outwardly and away from the adjacent seat cushion sub-assembly support 18. In a manner similar to the securement of the angle member 66, following assembly, a wedging action of downwardly inclining lip 72*c* on the adjacent periphery of the slot will prevent movement of the lip 72*c* and the angle member 72 itself. The rigid seat frame 38 used in connection with this second embodiment of the angle member 72** need not be tubular, and may be of any desired cross-section.

Referring now to FIG. 1, laterally opposed from the movably secured angle members 66 in the tubular frame 38, are a pair of fixedly secured angle members 76. These angle members 76 may be of any suitable configuration or cross-section, but in the embodiment depicted in the drawings and as particularly shown in FIG. 3, the angle members 76 are generally L-shaped and made of flat stock. The angle members 76 are fixedly secured to the rigid seat frame member 38, as by welding.

Both angle members 66 and 76 extend downwardly from the rigid frame member 38 and through apertures 78 in bottom panel 36, thereby extending beyond the peripheries of that bottom panel. The finished seat cushion sub-assembly 26, as shown in FIG. 6, is then ready for assembly into the chair 10. The assembly requires placement of the seat cushion sub-assembly 26 above and adjacent the seat cushion sub-assembly support 18. Wood screws 80 or similar fasteners are then placed through the holes in the fixedly secured angle members 76, and these wood screws 80 or similar fasteners are secured to the seat cushion sub-assembly support 18 through adjacent, pre-drilled or pre-set screw-retaining holes 82. In the context of the present invention, "pre-drilled" and "pre-set" holes are deemed equivalent. The concept of "pre-drilled" or "pre-set" means that holes have been provided in the seat cushion sub-assembly support 18. Preferably, the screws 80 are receivable in a threaded element. The threaded element may include, in addition to a threaded inner cavity for receipt of screw 80, a threaded external portion for screwing that element into the seat cushion support frame 18. The pre-set screw retaining holes 84 also preferably are formed from such threaded elements.

Because of variations in the positions of both the pre-drilled or pre-set screw-retaining holes in the seat cushion sub-assembly support 18, and in the dimensions and hole locations in the angle members; and because some of the manufactured rigid seat frames 38 may be somewhat offset from a true, planar configuration, it has been found in practice that if angle members 66 were also fixedly secured to the rigid seat frame 38, the holes in the vertical leg **66*a* of movably secured angle members 66 may not have been properly alignable with their corresponding, pre-drilled or pre-set screw-retaining holes 84. In that event, it would have been impossible for the assembler to affix wood screw or similar fastener 86 to the pre-drilled or pre-set screw-retaining hole 84 in seat cushion support frame 18**.

To solve this problem, the present invention provides for interconnecting means in the form of the above-described movably secured angle members 66. The angle members 66 are denominated "movably secured" because prior to assembly of the angle members 66 to seat cushion support frame 18 with wood or other screws 86, the angle members 66 can move vertically or laterally within their slots 70 to accommodate the above-described manufacturing variations or misalignment. When the angle member 66 has been secured to seat cushion sub-assembly support 18 with wood or other screw 86, the angle member 66 or its downwardly inclining lip 68 orients itself within its slot 70 to accommodate the newly established alignment of the screw 86 and screw-retaining hole 84. The resultant wedging action of the downwardly inclining lip 68 or angle member 66 against the periphery of the slot 70 creates a tight and secure fit of the angle member 66 within the slot of rigid seat frame 38.

It should also be understood and fully apparent to those skilled in this art that in the event that the movably secured angle members 72 are made of round rather than flat stock, then the slots accommodating those angle members 72 will also be round, and of a very slightly greater diameter than the diameter of the angle members 72 themselves. As generally described above, accommodation for misalignment of the holes **83*b* in the vertical leg 72*a* of angle member 72 with its corresponding screw-retaining hole in seat cushion sub-assembly support 18 is provided by the rotatable and outward movement of the angle members 72 within their corresponding slots in the seat frame member 38**.

It should be readily apparent to those skilled in this art that the components and sub-assemblies described above may be readily used in kits for the manufacture of chairs of various types and descriptions. Such kits and such chairs using the above-described and claimed components and sub-assemblies are also claimed, and are of course deemed as within the scope of the claimed invention by the inventor.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention is appropriate instances even the specific claims involved should be construed in light of the doctrine of equivalents.

What I claim is:

1. A seat cushion sub-assembly to be mounted upon a seat cushion support frame, said sub-assembly comprising a cushion, a rigid cushion frame supported beneath said cushion; an outer fabric cover for said frame and cushion and including a normally exposed panel, four side panels extending from the margins of said top exposed panel, and a normally unexposed bottom panel having at least one pair of connecting means pass-through apertures and a panel cover flap, said cover flap being removably engaged to form an opening to permit insertion of said rigid frame and said cushion within said cover, and means for releasably securing said cover flap in a closed position to eliminate said opening; and at least a first pair of connecting means adjustably secured to said frame and having vertical mounting legs passing downwardly through said bottom panel, said vertical mounting legs having connecting means-receiving apertures, said legs being adjustable in position over a limited extent to enable their securement to a chair frame by securing means passing through said securing means-receiving apertures and into pre-formed apertures in said seat cushion support frame by aligning said connecting means-receiving apertures in said vertical legs with said pre-formed apertures by a slight position adjusting action, where necessary.

2. The seat cushion sub-assembly as set forth in claim 1, wherein said rigid cushion frame includes a rectangular frame with two pairs of opposite side members and cushion support means extending between said pairs of opposite side members, a first pair of spaced horizontally facing slots in the inner side of one of the members of said first pair of said side members, said connecting means including a first pair of screw-receiving angle members having horizontal legs extending into said slots, and said mounting legs being vertical legs on said first pair of angle members and having openings to receive screws to be threaded into pre-drilled holes in said chair frame.

3. The cushion sub-assembly as set forth in claim 2 wherein said first pair of angle members are made of generally round stock and rotatable within their corresponding slots to compensate for variance in the location of screw-retaining holes in said chair frame.

4. In a chair comprising rectangular side frame members having floor-engaging bottom portions, back cushion-supporting upper portions and a seat cushion support frame supporting intermediate portion; a seat cushion sub-assembly support frame having horizontally facing screw-thread holes therein; first securing means for securing said seat cushion sub-assembly support frame to said intermediate portions of said side frame members; a back cushion sub-assembly; and second securing means for securing said back cushion sub-assembly to the upper portions of said side frame members; the improvement wherein said chair includes a substantially rectangular seat cushion sub-assembly removably attached to said seat cushion sub-assembly support frame; said seat cushion sub-assembly comprising a rigid rectangular seat frame having horizontally facing apertures in the sides thereof; a cushion; an outer fabric cover, including a normally exposed top panel, four side panels secured to said top panel, a normally unexposed bottom panel, and a normally unexposed cover flap, said cover flap being removably connected to three sides of said bottom panel to thereby permit insertion of said rigid seat frame and cushion within said outer fabric cover; a first pair of connecting members secured to said rigid seat frame and having vertical legs with horizontally facing screw-receiving holes in the bottom portions thereof, said first pair of connecting members being fixedly secured to said seat frame; and a second pair of connecting members secured to said seat frame, said second pair of connecting members having horizontal legs inserted into said horizontally facing apertures in said seat frame, and vertical mounting legs having horizontally facing screw-receiving holes in the bottom portions thereof, said horizontal legs being initially adjustable within said seat frame apertures to vary over a limited extent the position of said screw-receiving holes therein; and said bottom cover panel further including apertures through which the vertical legs of said first and second pairs of connecting members downwardly extend from said rigid seat frame and project below said bottom cover panel; and screws passing through said screw-receiving holes of said vertical legs of said first and second pair of connecting members and threaded into said threaded holes of said seat cushion sub-assembly support frame.

5. The chair as set forth in claim 4 wherein said back cushion sub-assembly comprises an outer fabric cover including a normally exposed top panel, a plurality of side panels secured to said top panel, a rear panel secured to said side panels and a removably engaged, normally unexposed cover flap, said cover flap being removably engaged to said rear panel; a cushion in the front portion of said cover; and a rigid, back cushion frame member behind said cushion, said back cushion frame member being removably mounted within said outer fabric cover and having horizontally facing holes for insertion of interconnecting means, and interconnecting means interconnecting the upper portions of said chair side frame members to said rigid back cushion frame member through said holes.

6. A seat cushion sub-assembly comprising a rectangular rigid seat frame comprising a first and second pair of opposed horizontal arms between which cushion support means extend, the sides of one of said arms of said first pair of arms including a pair of horizontally facing slots, a first pair of angle members having horizontal legs adjustably received in said slots and vertical legs having screw-receiving holes at the bottom portions thereof; and a second pair of angle members fixedly secured to the other arm of said first pair of arms, said fixedly secured angle members having vertical legs with screw-receiving holes at the bottom portions thereof.

7. The seat cushion sub-assembly of claim 2 or 6 wherein each of said horizontal legs of said first pair of removably received angle members includes a downwardly inclining lip which enters its corresponding arm slot.

8. The seat cushion sub-assembly of claim 6, wherein said first pair of removably received angle members are made of a generally flat stock.

9. The seat cushion sub-assembly of claim 6, wherein said first pair of angle members are made of generally round stock to be initially rotatably and outwardly movable within their corresponding arm slots.

10. A chair including said cushion sub-assembly of claim 1.

11. A chair including the sub-assembly of claim 2, 3, and 4.

12. A chair including the sub-assembly of claim 3.

13. A chair including the seat cushion assembly of claim 6, 7, 8 or 9.

14. A chair made by the construction and utilization of the rigid seat frame in accordance with claim 9.

15. A chair made by the construction and utilization of the seat cushion sub-assembly of claim 10.

16. The cushion sub-assembly of claim 21 wherein said rigid cushion frame includes a rectangular frame with two pairs of opposite side members and cushion support means extending to a first and second pair of spaced slots in the inner sides of one of said pair of frame side members, said first pair of connecting means having horizontal legs extending into one of said pair of slots and shiftable in position therein, and a second pair of angle members having horizontal legs extending into the other pair of slots and vertical legs having openings to receive screws to be threaded into pre-drilled holes in said chair frame.

17. The cushion sub-assembly of claim 16 wherein said second pair of angle members have their horizontal legs welded to said cushion support frame.

18. The chair of claim 5 wherein the defining walls of said holes in said back cushion frame member is made of a rigid metal or metal-like material.

* * * * *